US006164628A

United States Patent [19]

Hoggan

[11] Patent Number: 6,164,628

[45] **Date of Patent: *Dec. 26, 2000**

[54] SELF-LOCKING SLAT WITH FINS FOR CHAIN LINK FENCES

[75] Inventor: Jefrey A. Hoggan, River Heights, Utah

[73] Assignee: A&B Plastics, Inc., Union Gap, Wash.

[ * ] Notice: This patent is subject to a terminal disclaimer.

[21] Appl. No.: 09/026,595

[22] Filed: Feb. 20, 1998

Related U.S. Application Data

[63] Continuation-in-part of application No. 08/804,223, Feb. 21, 1997, Pat. No. 5,775,676, and a continuation-in-part of application No. 08/804,324, Feb. 21, 1997, abandoned.

[51] Int. Cl.[7] ..... B21F 27/00; E04H 17/06

[52] U.S. Cl. ..... 256/34; 256/32

[58] Field of Search ..... 256/34, 32–38, 256/45, 47, 19

[56] References Cited

U.S. PATENT DOCUMENTS

| | | | |
|---|---|---|---|
| 338,818 | 3/1886 | Baird | 256/34 |
| 2,892,647 | 6/1959 | O'Neill | 287/58 |
| 2,954,964 | 10/1960 | O'Haffey | 256/34 |
| 3,227,423 | 1/1966 | De Matteo | 256/12.5 |
| 3,712,590 | 1/1973 | Tochner et al. | 256/34 |
| 3,958,794 | 5/1976 | Suprunuk et al. | 256/34 |
| 4,343,567 | 8/1982 | Sarver et al. | 404/10 |
| 4,570,906 | 2/1986 | Walden | 256/34 |
| 4,723,761 | 2/1988 | Cluff | 256/34 |
| 4,860,998 | 8/1989 | Snyder | 256/34 |
| 4,950,098 | 8/1990 | Abbott et al. | 256/34 |
| 5,007,619 | 4/1991 | Sibeni | 256/34 |
| 5,184,801 | 2/1993 | Finkelstein | 256/34 |
| 5,584,468 | 12/1996 | Meglino et al. | 256/34 |
| 5,687,957 | 11/1997 | Finkelstein | 256/34 |
| 5,775,676 | 7/1998 | Hoggan | 256/34 |
| 5,806,839 | 9/1998 | Meglino | 256/34 |

FOREIGN PATENT DOCUMENTS

| | | | |
|---|---|---|---|
| 2 476 736 | 8/1981 | France | 256/34 |

*Primary Examiner*—Harry C. Kim

*Attorney, Agent, or Firm*—Jacobson, Price, Holman & Stern, PLLC

[57] ABSTRACT

A slat for use in chain link fences is provided. The slat generally includes an elongated, imperforate body member and at least first and second fins extending laterally and proximally relative to and from the body member. The first and second fins of the slat may be configured and oriented to extend into knuckles of a chain link fence such that end portions of the first and second slats are pinched or frictionally engaged within the knuckles of a chain link fence, which locks or secures each slat within a corresponding channel of a chain link fence. The slat may further include third and fourth fins which extend laterally and distally relative to the body member for engaging portions of the wire mesh fencing fabric to inhibit rotational movement of the slats within corresponding channels of the chain link fence.

17 Claims, 3 Drawing Sheets

SELF-LOCKING SLAT WITH FINS FOR CHAIN LINK FENCES

This application is a continuation-in-part of application Ser. No. 08/804,223, filed on Feb. 21, 1997, now U.S. Pat. No. 5,775,676, and of application Ser. No. 08/804,324, filed on Feb. 21, 1997, now abandoned.

FIELD OF THE INVENTION

The present invention generally relates to chain link fences, and in particular, to slats for use in chain link fences.

BACKGROUND OF THE INVENTION

As noted in commonly assigned U.S. Pat. No. 4,860,998 entitled "Slatted Chain Link Fence Construction, Slats Therefor, and Method of Slat Installation," chain link fences are typically constructed from an open, wire mesh fencing fabric which is woven diagonally so that alternate links zig-zag vertically and lie in different planes. Such links form knuckles or weaves in which the wire forming such knuckles twists about the wire that forms laterally adjoining links. In this regard, laterally adjoining channels are formed vertically and diagonally along the height of a chain link fence constructed from wire mesh fencing fabric and such channels are open at their opposite (e.g., top and bottom) ends. As such fencing mesh is not closely woven, it does not conceal from view anything on either side of the chain link fence.

As further noted in U.S. Pat. No. 4,860,998, efforts have been made to obtain a degree of privacy by inserting slats of wood, aluminum or plastic into adjoining channels of the chain link fence, either vertically or diagonally. However, because of the knuckles and the inherent twisting forces generated by chain link fences, which warps some slats, complete concealment has been difficult to achieve.

Due to the effects of gravity and wind forces, efforts have also been made to secure vertically extending slats within channels of chain link fences. Generally, slats have been locked within channels by mechanically linking adjacent slats and/or by using a horizontally extending slat to support the slats. However, utilizing such devices to secure slats within chain link fences is a labor intensive effort, which in turn, increases the time and costs associated with installing such slats.

SUMMARY OF THE INVENTION

Accordingly, it is an object of the present invention to provide a slat for use in a chain link fence to provide privacy at all visible angles.

Another object of the present invention is to provide a slat which is easily installable within a channel of a chain link fence.

A further object of the present invention is to provide a self-locking slat for use in chain link fences.

Yet another object of the present invention is to provide a slat which is capable of remaining locked within a channel of a residential or industrial sized chain link fence, even in instances where the slat is subject to various loading (e.g., gravity, wind, etc.).

Still another object of the present invention is to provide a rigid slat which inhibits twisting due to various loading (e.g., gravity, wind, etc.) on the slat.

The above objects of the present invention can be fulfilled by providing a slat having a body member and at least first and second fins extending from the body member for frictionally engaging at least a first pair of knuckles to secure the slat within a channel of a chain link fence. First and second fins meeting the requirements of the present invention provide privacy and self-locking characteristics as the first and second fins are configured and oriented to extend into and engage opposing knuckles of a chain link fence.

In one embodiment, the present invention is directed to a slat having a body member and first and second fins extending along and from the body member. Such a slat is insertable within a channel of a chain link fence, the channel being defined by proximal and distal portions of wire mesh fencing fabric of the chain link fence and on opposite sides by a plurality of intermittently spaced, opposing knuckles which are defined at intersections of the wires of the wire mesh fencing fabric. For purposes of providing privacy and providing a self-locking slat that is automatically securable in a channel of a chain link fence and capable of remaining locked even when subjected to adverse loading conditions, the first and second fins may extend from and along longitudinal sides of the body member, proximate a proximal face sheet (e.g., wall) of the body member, laterally and proximally, toward and into the knuckles of the chain link fence to frictionally engage the knuckles, and specifically, the twisted wires at intersections of the wire mesh fencing fabric. End portions of such first and second fins are pinched or captured within corresponding knuckles to lock the slat within a respective channel. And, due to the thickness and strength of such end portions of at least the first and second fins, the slat remains locked within the channel, even when subjected to loading, since at least the end portions resist ripping and/or tearing. Such resistance to ripping/tearing is important since the slats of the present invention, especially the wider width slats (e.g., industrial), may be subjected to adverse wind loading. In addition, the first and second fins of the slats of the present invention extend into the knuckles of a chain link fence and toward first and second fins of adjacently positioned slats to thereby minimize any gaps between adjacently positioned slats to thereby enhance privacy.

In another embodiment of the present invention, the slats of the present invention are capable of resisting the natural twisting tendency of the chain link fence. Such slats further include third and fourth fins for inhibiting rotational movement of the slat relative to the channel. More specifically, in this embodiment, third and fourth fins extending along and from longitudinal sides of the body member, proximate a distal face sheet (e.g., wall) of the body member, are provided to abuttingly engage distal portions of the wire mesh fencing fabric to inhibit rotational movement of the slats within corresponding channels. In this regard, the third and fourth fins are configured and oriented to extend laterally and distally, relative to the body member, such that at least a segment of one of the third and fourth fins is abuttingly engageable with a distal portion of the wire mesh fencing fabric depending upon whether the chain link fence is "right-hand" or "left-hand" woven. As such, the third and fourth fins resist the chain link fence's natural tendency to twist.

In instances where a wider slat is desired (e.g., for industrial size chain link fences), resistance to twisting may be enhanced by providing at least a first longitudinally extending rib within the body member to improve the rigidity of the slat. The first longitudinally extending rib may extend between and interconnect the distal and proximal walls of the body member. In one embodiment, for purposes of further enhancing such rigidity, first and second longitudinally extending ribs may extend between the distal and proximal walls of the body member.

For purposes of facilitating installation of the slats of the present invention into the channels of the chain link fence, a first width of the slat, defined by the distance between the end portions of the first and second fins, is preferably greater than a second width of the slat, defined by the distance between end portions of the third and fourth fins.

The slats of the present invention may be fabricated from a variety of plastic materials having the characteristics of a high or medium density polyethylene material. Use of a material having such characteristics provides a structurally stable, yet flexible slat capable of resisting buckling from compressive forces during installation of the slat into a channel of a chain link fence, and provides resistance to tearing, especially in the areas of the first and second fins (e.g., end portions) which are pinched or wedged within the knuckles of the chain link fence. Such resistance to tearing is especially importance when wider slats for industrial sized fences are required, which may be subject to adverse loading from wind forces due to the large surface area of such slats. Use of such plastic materials is also beneficial in the manufacture of the slats of the present invention as such slats may be extruded from the above-noted plastic materials to form slats having fins that are integrally formed with the body member.

For purposes of enhancing resistance of the slat to buckling during installation of a slat into a channel of a chain link fence, the body member of a slat of the present invention may have polygonal cross-sectional configuration. In one embodiment, the body member has a rectangular cross-sectional configuration. In addition, the body member may be hollow to provide a lightweight, flexible slat capable of easy installation. The body member may also be imperforate to enhance privacy.

DETAILED DESCRIPTION OF THE INVENTION

The slats of the present invention are generally used in association with chain link fences. More specifically, the slats of the present invention are insertable within channels of a chain link fence to provide privacy to an end user. Such channels are defined by the wire mesh fencing fabric and by the intermittently spaced, opposing knuckles at intersections of the wire mesh fencing fabric. In addition, each slat of the present invention has self-locking features which enable the slat to be automatically secured with a channel of a chain link fence. As such, each slat of the present invention is configured to frictionally engage the chain link fence, specifically, the knuckles of the chain link fence, to positionally lock each slat within a channel. Furthermore, the slats may be additionally capable of resisting the inherent twisting force in chain link fences. In this regard, the slats of the present invention may be configured to inhibit rotational movement of a slat within a channel of the chain link fence.

For ease of description, in the discussion of the slats 10 of the present invention, the term "distal" refers to the direction toward a back side or face of the chain link fence 16. Correspondingly, the term "proximal" refers to the direction toward the front side of the chain link fence 16, the front side of the fence 16 being illustrated in FIG. 1.

Figure 1:
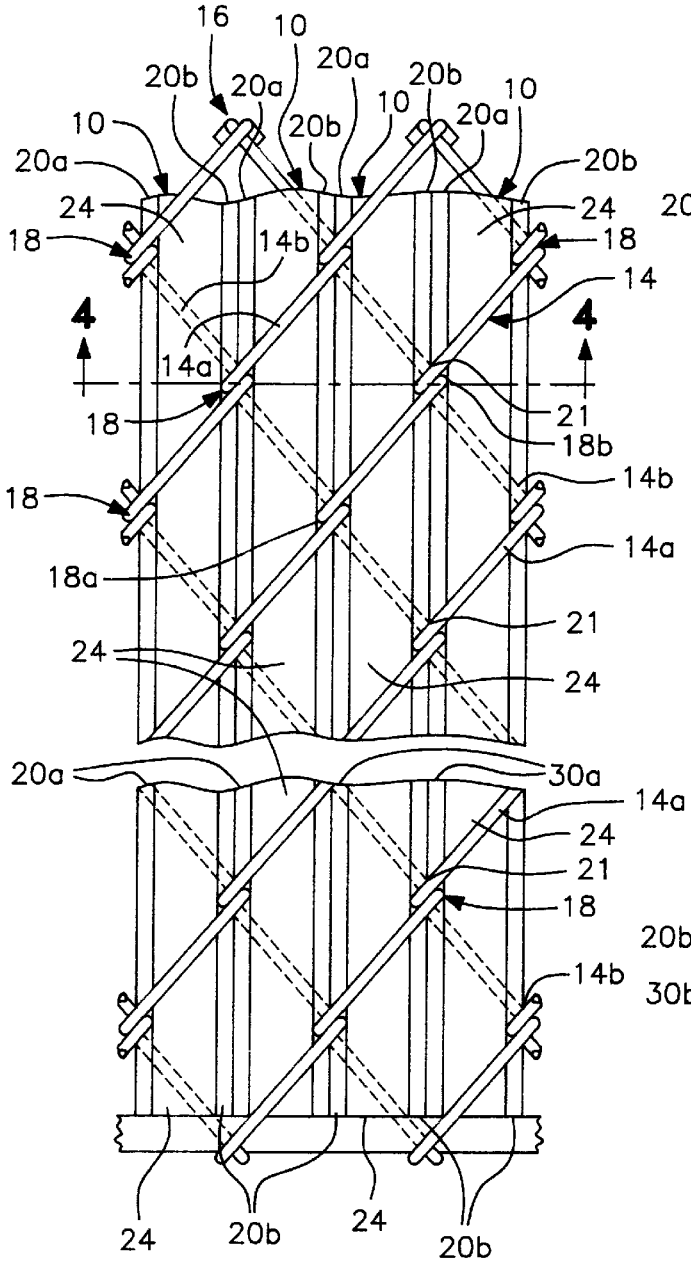
FIG. 1 is an elevational view of a chain link fence having the self-locking slats with fins of the present invention positioned therein, an intermediate portion being broken out for convenience of illustration.
Figure 2:
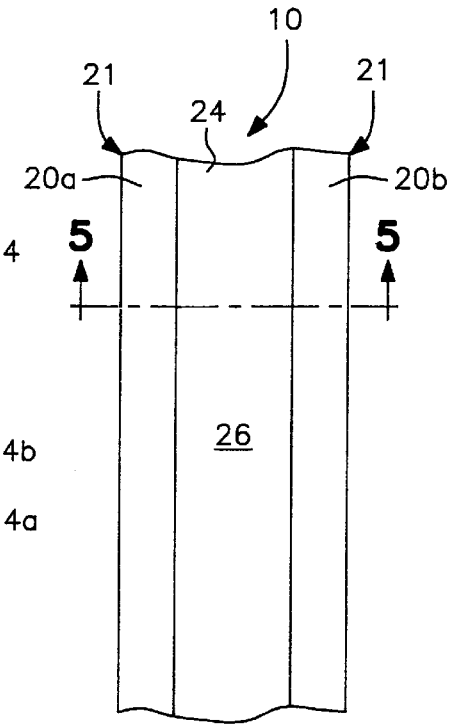
FIG. 2 is a sectional view of the front face of one of the slats of the present invention illustrated in FIG. 1.
Figure 3:
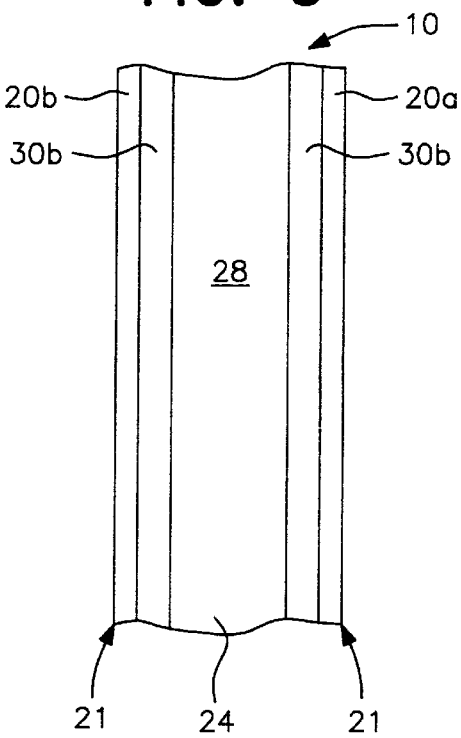
FIG. 3 is an elevational view of a back face of one of the slats of the present invention illustrated in FIG. 1.
Figure 4:
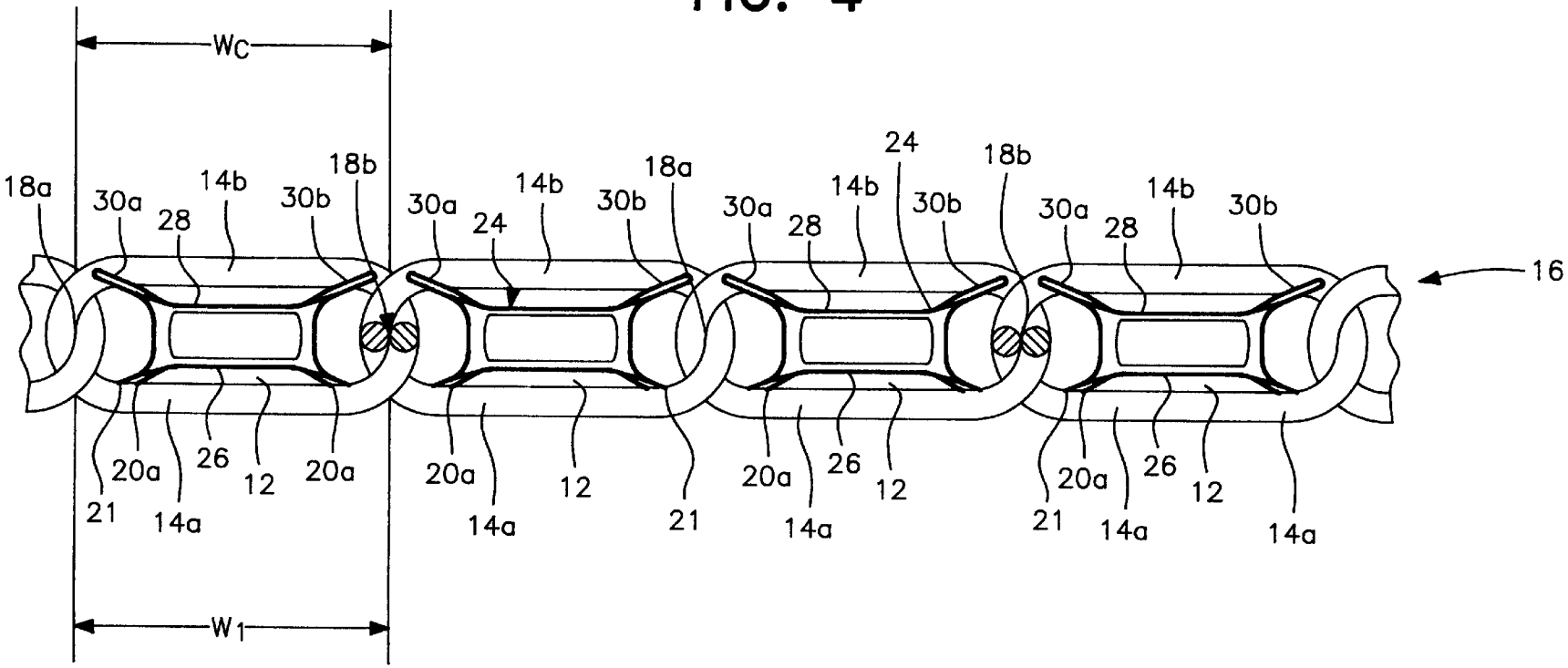
FIG. 4 is a cross-sectional view taken along line 4—4 of FIG. 1 and drawn to a larger scale.

Referring to FIGS. 1 and 4, in one embodiment, the slats 10 of the present invention are configured to be installed within channels (e.g., vertical, diagonal) 12 of the wire mesh fencing fabric 14 of a chain link fence 16. Such channels 12 are defined by proximal and distal portions 14*a*, 14*b* of the wire mesh fencing fabric and by the intermittently spaced, opposing weaves or knuckles 18 which are defined by twists of wire in the wire mesh fencing fabric 14. Opposing knuckles 18*a*, 18*b*, illustrated in FIGS. 1 and 4 define a channel width, $w_c$, of the chain link fence.

In one embodiment, for purposes of providing privacy and for providing a slat 10 which is capable of self-locking within a channel 12 of the chain link fence 16, each slat 10 includes at least two fins 20 (e.g., fins 20*a*, 20*b*) which extend laterally outwardly and proximally from and relative to a body member 24 of the slat 10. As illustrated in FIGS. 1–4, in this embodiment, the proximally extending fins 20*a*, 20*b* are sized and configured to extend into the opposing knuckles 18 (e.g., knuckles 18*a*, 18*b*) such that end portions 21 of the proximally extending fins 20*a*, 20*b* are frictionally engageable or pinchable (e.g., wedgeable, capturable) within corresponding knuckles 18. In this regard, the proximally extending fins 20*a*, 20*b* of the slats 10 of the present invention are sized and oriented to be frictionally engaged within the knuckles 18 to positionally lock each slat 10 within the channels 12 of the wire mesh fabric 14 of the chain link fence 16.

The proximally extending fins 20 of the slat 10 of the present invention also provide privacy, such that a viewer on a proximal side of the chain link fence 16 is inhibited from viewing anything on the distal side of the chain link fence 16, and vice versa, regardless of the viewing angle. For purposes of providing such privacy while providing a slat 10 which is self-locking, the fins 20*a*, 20*b*, which extend proximally relative to the body member 24, extend toward opposing knuckles 18 of a channel 12 and also toward the fins 20*a*, 20*b* of an adjacently positioned slat 10, as illustrated in FIGS. 1 and 4, to extend into any gaps between adjacently positioned slats. In this regard, and as further illustrated in FIG. 5, the fins 20*a*, 20*b* of the slat 10 define a width, $w_1$, which is at least as wide as the channel 12 width, $w_c$, as illustrated in FIG. 4, which corresponds to a distance between opposing knuckles (e.g., knuckles 18*a*, 18*b*). In one embodiment, the first slat width, $w_1$, is greater than the channel width, $w_c$. Such sizing of the slats 10 enhances privacy from all viewing angles when a plurality of the slats 10 are inserted into corresponding adjacent channels 12, as illustrated in FIGS. 1 and 4. In one embodiment, to provide a slat 10 having fins 20 capable of providing privacy and for locking the slat 10 within a channel 12, the fins 20*a*, 20*b* are configured to extend proximally, relative to the body member 24. In particular, and relative to a proximal face sheet 26 of the body member 24, the fins 20*a*, 20*b* are oriented at an angle, , the angle being between about 0° and about 30° and, more preferably, between about 0° and about 20°, and in a preferred embodiment, between about 5° and 15°.

For purposes of inhibiting rotational movement of the slats 10 due to the inherent twisting forces in the chain link fence 16 (e.g., in "right-hand" chain link fences), the slats 10 further include, in another embodiment, fins 30 (e.g., fins 30*a*, 30*b*). The fins 30 may be configured and/or oriented to substantially abuttingly engage segments or portions of the wire mesh fencing fabric 14, and specifically, distal portions 14*b* of the wire mesh fencing fabric 14 (e.g., for "right-hand" chain link fences). In particular, and as illustrated in FIGS. 1, 3–5, fins 30*a*, 30*b* extend at least laterally outwardly toward knuckles 18, and extend distally, relative to the body member 24, to engage distal portions 14*b* of the wire mesh fencing fabric 14. In one embodiment, the fins 30*a*, 30*b* are oriented at an angle, β, relative to a distal face sheet 28 of the body member 24, the angle β being between about 35° and 55° and, more preferably, between about 40° and 50°.

In a preferred embodiment, for purposes of facilitating insertion of a slat 10 within the channel 12, a second slat width $w_2$, defined by the distance between end portions of the third and fourth fins 30*a*, 30*b*, is less than the channel width, $w_c$, and, is preferably less than the first slat width, $w_1$, defined by the fins 20*a*, 20*b*. A ratio of the first slat width, $w_1$, to the second slat width, $w_2$, of the present invention is between about 5:4 and about 10:9.

Figure 5:
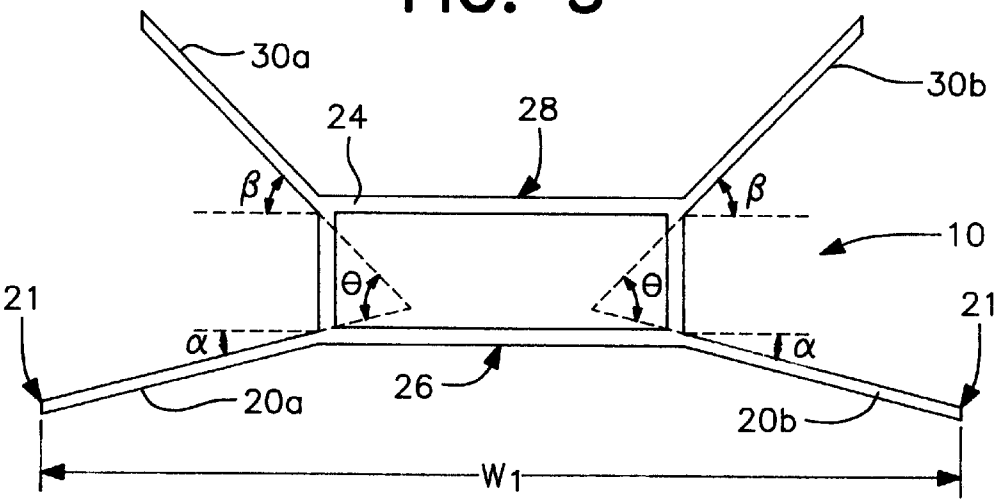
FIG. 5 is a cross-sectional view of another embodiment taken along line 5—5 of FIG. 2 and drawn to a larger scale.

In another preferred embodiment, illustrated in FIG. 5, for purposes of providing an easily installable, self-locking slat 10 which provides privacy and inhibits rotational movement of the slat 10 within a channel 12 of a chain link fence 16, the proximally and distally extending fins 20, 30 are oriented and configured relative to each other at an offset angle, θ. In one embodiment, the offset angle θ, between the first and third fins 20*a*, 30*a*, and between the second and fourth fins, 20*b*, 30*b*, is between about 40° and about 60°, and in a preferred embodiment, between about 45° and 55°.

The body member 24, illustrated in FIGS. 1–4, is elongate to extend between top and bottom portions of the chain link fence 16. Further, the body member 24 is preferably imperforate in order to further enhance privacy. In addition, in a preferred embodiment, the body member 24 is hollow to provide a lightweight slat 10, and has a polygonal cross-sectional configuration (e.g., rectangular, square) to provide a slat 10 capable of resisting compressive forces during installation of the slat 10 into a channel 12. In this regard, the slats 10 may be installed vertically into the channels 12 without buckling from compressive forces.

Figure 6:
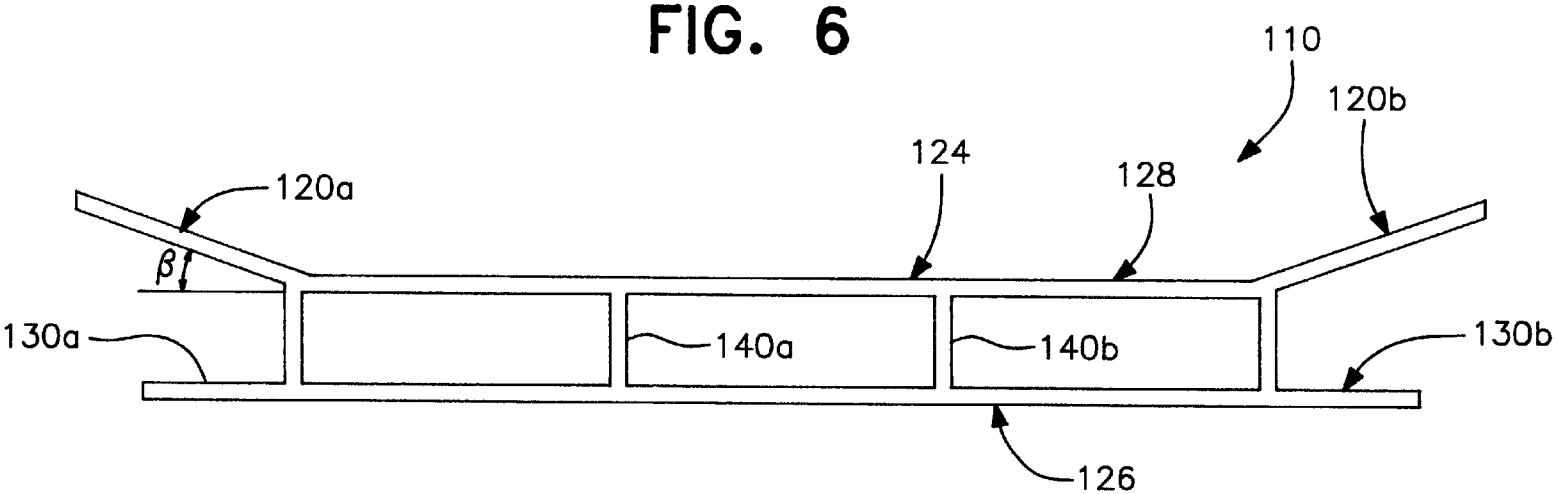
FIG. 6 is a cross-sectional view of another embodiment of the slat of the present invention, illustrating a slat with improved rigidity.

In an alternative embodiment, illustrated in FIG. 6, for purposes of increasing the rigidity of the body member 124, the slat 110 includes first and second longitudinally extending ribs 140*a*, 140*b* which extend between the proximal and distal walls 126, 128 of the body member 124. Such ribs 140*a*, 140*b* are particularly useful in the wider, industrial sized slats since such slats must resist the natural tendency of the woven chain link fence to twist and adverse wind loading (e.g., since such slats have a larger surface area than residential sized slats). The ribs 140*a*, 140*b* are preferably integrally formed with the proximal and distal walls 126, 128 of the slat 110, and are oriented perpendicular to the proximal and distal walls 126, 128. In this embodiment, the ribs 140*a*, 140*b* have a thickness substantially equal to that of the proximal and distal walls 126, 128 (e.g., 0.030 inches). In this embodiment, the slat 110 includes first and second fins 120*a*, 120*b*, the end portions of which are receivable and pinchable within the knuckles of a chain link fence, and further includes third and fourth fins 130*a*, 130*b* which are abuttingly engageable with the distal portion of the chain link fence to further inhibit twisting of the slat 110. The first and second fins 120*a*, 120*b* are oriented at about 200 relative to the distal wall 128.

In one embodiment, the slats of the present invention are fabricated from a plastic material, such as high density polyethylene, medium density polyethylene, linear low density polyethylene (co-extruded), polypropylene copolymer, ethyl-vinyl acetate or low density polyethylene. In one embodiment, the slats 10 (e.g., body member 24, fins 20, 30, ribs 140) are fabricated from a plastic material having a tensile strength of at least about 1000 psi to inhibit tearing of the end portions 21 which are pinched within the knuckles 18 of the chain link fence 16. In a preferred embodiment, the slats 10 are fabricated from a higher strength plastic material having a tensile strength of at least about 2500 psi. In yet another preferred embodiment, the slats are fabricated from high density polyethylene having a tensile strength of about 4400 psi. For such plastic materials, the end portions of the slats should have a thickness of at least about 0.018 inches (e.g., 0.020 inches for industrial sized slats) inches to further resist tearing to thereby keep the slat locked within the channel of the chain link fence, which is especially important for industrial sized slats, which are subject to greater wind loading due to the increased surface area of the slat, as compared to residential sized slats. A body member and/or ribs fabricated from such plastic materials may have a wall thickness of at least about 0.026 inches (e.g., 0.030 inches for industrial sized slats) to resist buckling during installation of the slats into the channels and to resist twisting of the slat. Further, the slats may be extruded from such plastic materials into the configuration (e.g., cross-sections) illustrated. The fins may be integrally formed with the body member. However, such fins may also be mechanically attached to the body member.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described here and above are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. In combination, a chain link fence having a plurality of channels comprising front and rear faces defined by proximal and distal portions of a wire mesh fencing fabric and opposite sides defined by a plurality of intermittently spaced, opposing knuckles at intersections of the wire mesh fencing fabric, the space between opposing knuckles defining the width of the channels, and slats retained in selected channels, each of said slats comprising:

an elongate, imperforate body member having distal and proximal face sheets, first and second fins extending laterally outwardly from said body member, wherein said first and second fins define a first width of said slat greater than the width of said channel such that at least end portions of said first and second fins extend into and are captured within their associated knuckles to positionally lock said slat within its associated channel, said first and second fins extending from said proximal face sheet of said body member and being oriented between about 0° and about 30° relative to said proximal face sheet of said body member, and third and fourth fins extending laterally outwardly from said body member and inhibiting rotational movement of said slat relative to its associated channel, wherein at least a segment of at least one of said third and fourth fins is abuttingly engaged with a distal portion of the wire mesh fencing fabric, said third and fourth fins extending from said distal face sheet of said body member and being oriented between about 35° and about 55° relative to said distal face sheet of said body member.

2. A combination, as claimed in claim 1, wherein said end portions of said first and second fins are pinched within and by said associated knuckles between twisted portions of the wire mesh fencing fabric.

3. A combination, as claimed in claim 1, further comprising at least one rib extending between said distal and proximal face sheets of said body member.

4. A combination, as claimed in claim 1, wherein at least said end portions of said first and second fins have a thickness of at least about 0.018 inches.

5. A combination, as claimed in claim 1, wherein at least said end portions of said first and second fins are fabricated from a plastic material and have tensile strength of at least about 1000 psi.

6. A combination, as claimed in claim 5, wherein said end portions of said first and second fins have a thickness of at least about 0.018 inches.

7. A combination, as claimed in claim 1, wherein offset angles defined between said first and third fins and between said second and fourth fins are between about 40° and about 60°.

8. A combination, as claimed in claim 1, wherein said first and second fins are longer than said third and fourth fins respectively.

9. A combination as claimed in claim 1, wherein said first and second fins define a first width of said slat and said third and fourth fins define a second width of said slat, wherein a ratio of said first width of said slat to said second width of said slat is between about 5:4 and about 10:9.

10. A slat for insertion in a channel of a chain link fence, the channel comprising front and rear faces defined by proximal and distal portions of a wire mesh fencing fabric and opposite sides defined by a plurality of intermittently spaced, opposing knuckles at intersections of the wire fencing fabric, said slat comprising:

an elongate body member having distal and proximal face sheets;

first and second fins integrally formed with, and extending laterally outwardly from, said proximal face sheet of said body member, and having end portions adapted to be received and pinched within a pair of opposing knuckles to positionally lock said slat within the channel, wherein at least one of said first and second fins is oriented at an angle between about 0° and about 30° relative to said proximal face sheet, further including means for inhibiting rotational movement of said slat within its associated channel of the chain link fence comprising third and fourth fins integral with, and extending outwardly from, said distal face sheet of said body member toward distal portions of the wire mesh fencing fabric, wherein at least a segment of at least one of said third and fourth fins is adapted to abuttingly engage with the distal portions of the wire mesh fencing fabric, and wherein at least one of said third and fourth fins is oriented at an angle between about 35° and about 55° relative to said distal face sheet.

11. A slat, as claimed in claim 10, further comprising at least a first rib extending between said distal and proximal face sheets of said body member.

12. A slat, as claimed in claim 11, wherein said first rib is oriented substantially perpendicular to said distal and proximal face sheets, and has a thickness of at least about 0.018 inches.

13. A slat, as claimed in claim 10, wherein at least said first and second fins are fabricated from a plastic material selected from the group consisting of high density polyethylene, medium density polyethylene, linear low density polyethylene, polypropylene copolymer, ethyl-vinyl acetate and low density polyethylene.

14. A slat, as claimed in claim 10 wherein offset angles defined between said first and third fins and between said second and fourth fins are between about 40° and about 60°.

15. A slat, as claimed in claim 10, wherein at least said end portions of said first and second fins are fabricated from a plastic material and have tensile strength of at least about 1000 psi.

16. A slat as claimed in claim 15, wherein said end portions of said first and second fins have a thickness of at least about 0.018 inches.

17. A slat, as claimed in claim 10, wherein said first and second fins are longer than said third and fourth fins respectively.

* * * * *